United States Patent [19]

Getselev

[11] 4,156,451

[45] May 29, 1979

[54] CONTINUOUS OR SEMI-CONTINUOUS METAL CASTING METHOD

[76] Inventor: Zinovy N. Getselev, prospekt Metallurgov, 73, kv. 29, Kuibyshev, U.S.S.R.

[21] Appl. No.: 875,921

[22] Filed: Feb. 7, 1978

[51] Int. Cl.[2] ..... B22D 27/02

[52] U.S. Cl. ..... 164/49; 164/250; 164/147

[58] Field of Search ..... 164/48, 49, 89, 146, 164/147, 444, 250, 251

[56] References Cited

U.S. PATENT DOCUMENTS

| | | | |
|---|---|---|---|
| 3,467,166 | 9/1969 | Getselev et al. | 164/48 |
| 3,646,988 | 3/1972 | Getselev | 164/89 |
| 3,713,479 | 1/1973 | Bryson | 164/444 |

*Primary Examiner*—Othell M. Simpson

*Assistant Examiner*—K. Y. Lin

*Attorney, Agent, or Firm*—Lackenbach, Lilling & Siegel

[57] ABSTRACT

A continuous or semi-continuous metal casting method comprising the feeding of a liquid metal upon a bottom plate arranged inside an orifice of an annular inductor and the shaping of molten metal into an ingot by the electromagnetic field of said inductor. The bottom plate with the metal is then lowered, and a cooling medium is supplied upon the lateral face of the ingot in several cooling tiers arranged at various levels longitudinally of the ingot. As the bottom of the ingot comes level with a next adjacent coolant tier along the motion of the ingot cooling tier, the cooling tiers, beginning from the topmost one, are cut out or off one after the other, and until the casting ends, the cooling medium is supplied upon the lateral face of the ingot by the cooling tier that maintains the solidification front substantially at the mid-height of the inductor.

3 Claims, 1 Drawing Figure

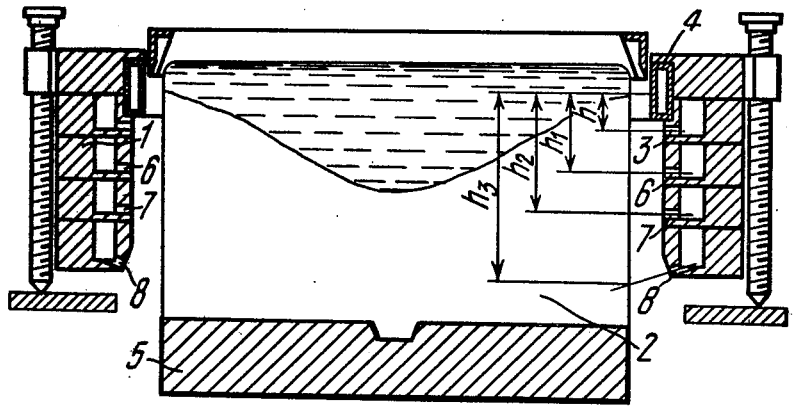
4
1
6
7
8
5
3
6
7
8
2
$h_1$
$h_2$
$h_3$

CONTINUOUS OR SEMI-CONTINUOUS METAL CASTING METHOD

FIELD OF THE INVENTION

The present invention relates to a method for continuous or semi-continuous casting of ferrous and nonferrous metals and their alloys and the shaping of metal ingots by an electromagnetic field.

DESCRIPTION OF THE PRIOR ART

A known method for continuous or semi-continuous casting of metal is disclosed in a British Pat. No. 1 157 977. In this patent, it is disclosed that molten metal is fed onto a bottom plate located in the orifice of an annular inductor, and the electromagnetic field of the inductor shapes the metal into an ingot. As the side surface of the ingot solidifies, the ingot with the bottom plate is lowered and, simultaneously, a cooling medium (water) is sprayed upon the side surface of the ingot. In accordance with British Pat. No. 1 328 166, the ingot is cooled by several cooling tiers arranged around and at different levels with respect to the ingot being shaped. The top cooling tier, ensuring the initial solidification of the ingot (appearance of the crust), is level with the bottom of the inductor. In the course of casting, the boundary between the molten and the solid phases on the surface of the ingot is close to mid-height of the inductor where the magnetic field is at its greatest. The liquid zone of the ingot shaped by an electromagnetic field has generally a height of 30 to 50 mm.

The shape of the liquid zone answering the normal ingot shaping conditions approximates in its longitudinal cross section that of the ingot, i.e. the liquid zone has a convex meniscus. This is achieved by shielding the magnetic field and also by that the top part of the liquid zone is found above the top plane of the inductor. Because of this, the height of the inductor with due regard for that of the liquid zone is generally 20 to 70 mm. When inductors of this height are used, known methods are applicable to casting of ingots at pulling velocities of 35 to 50 mm/min. As regards high-alloy aluminium alloys, the casting thereof into ingots at low pulling velocities (15 to 25 mm/min.) becomes altogether impossible, due to the causes as will be discussed hereinafter.

As is generally the case in casting, the boundary between the liquid and the solid phases on the side surface of the ingot is close to mid-height of the inductor where the magnetic field is at its greatest. The distance between said boundary and the top cooling tier is a function, in the main, of the ingot pulling velocity, varying inversely with the latter. Thus, when the ingot pulling velocity drops to 15 to 25 mm/min., the distance between the solid-liquid interface on the side surface of the ingot and the top cooling tier varies between 80 and 160 mm. As the top cooling tier is located directly underneath the inductor, and the liquid zone is not more than 50 mm high, the solidification front, for an inductor of customary height, emerges on the periphery of the liquid zone with the effect that the liquid metal entering the shaping zone trickles down and gives rise to random-shaped accretions on the side surface of the ingot, thus entirely upsetting the ingot shaping process. Consequently, a normal ingot shaping at low casting rates would require a lower arrangement of the top cooling tier with respect to the bottom boundary of the liquid zone on the surface of the ingot. This may be achieved by increasing the height of the inductor to 140 to 300 mm for pulling velocities of 15 to 25 mm/min. However, such a value of the inductor height is objectionable for many reasons. Assuming normal ingot shaping and minimizing consumption of energy, the optimum height of the inductor for a liquid zone 30 to 50 mm high is 30 to 70 mm.

In addition, as a greater inductor height increases the overall dimensions of the ingot casting means, this makes it difficult to incorporate them into continuous casting plants. An ingot casting means with an inductor of increased height cannot be used at both low and relatively high ingot pulling velocities (50 mm/min. and over), as the boundary between the solid and the liquid phases then moves into the bottom part of the inductor which is not practicable particularly with regards to ingot shaping and consumption of energy.

SUMMARY OF THE INVENTION

It is therefore a principal object of the invention to provide a method for continuous or semi-continuous casting of metal into ingots 500 to 1100 mm in diameter from alloys of low solidifcation rates.

Another object of the invention is to provide cast ingots by a single means at both low and high ingot pulling velocities so as to minimize the number of casters and the floorspace involved.

Still another object of the invention is to improve the surface quality of ingots, as a wide range of ingot pulling velocities eliminates the pulsation of the liquid phase of ingots and thus prevents the flowing of the liquid phase over the outside solidified lateral face or side surfaces of the ingot.

The above and other objects are attained by the method of continuous or semi-continuous casting of ferrous and nonferrous metals and their alloys comprising the feeding of a molten metal upon a bottom plate located inside an orifice of an annular inductor, and the shaping of an ingot of said metal by the electro-magnetic field of said inductor. Simultaneously with the lowering of the bottom plate when the side surfaces of the ingot solidify, a cooling medium is applied upon the lateral face of the ingot being cast with the aid of several cooling tiers arranged at different levels along the ingot. Flow of the coolant in the cooling tiers are cut out or off one after another beginning from the topmost one as the bottom of the ingot comes level with a next adjacent cooling tier along the motion of the ingot, and until the casting ends, the cooling medium is supplied to the cooling tier that maintains the liquid-solid interface on the lateral face of the ingot substantially at mid-height of the inductor. Sequential downward cut out or cut off of the cooling tiers maintains the liquid-solid interface on the lateral face of the ingot level at the mid-height of the inductor, as at low ingot pulling velocities the liquid-solid interface moves upward at a greater velocity than the velocity of ingot pulling. The effect of the cut out or cut off of the nearest cooling tier (or of several tiers in sequence) levels off the velocity of motion of the liquid-solid interface on the lateral face of the ingot and the ingot pulling velocity.

BRIEF DESCRIPTION OF THE DRAWING

These and other objects of the invention will now be described by way of example with reference to the accompanying drawing which is a schematic diagram in cross section of a vertical plane of an apparatus for putting the proposed method into effect.

DESCRIPTION OF THE PREFERRED EMBODIMENT

The method of continuous or semi-continuous casting of metal ingots is more particularly set forth in the following manner below.

At the beginning of casting, a cooling medium is supplied from an annular cooler 1 upon a lateral face of an ingot 2. This cooling medium is supplied in annular streams arranged at different levels along the ingot 2. A topmost cooling tier 3 is located directly beneath an inductor 4 at a distance h from the mid-height of the inductor 4. A normal course of the casting process is provided by maintaining the interface between the liquid and the solid phases on the lateral face of the ingot 2 placed on a bottom plate 5 at the mid-height of the inductor 4.

Lower cooling tiers 6, 7 and 8 are at distances respectively identified as $h_1$, $h_2$ and $h_3$ from the mid-height of the inductor 4.

The electromagnetic field of the inductor 4 causes the metal on the bottom plate 5 to take on the shape of a column of a specified height. Acted upon by the cooling medium, the column of molten metal begins to solidify from the bottom upwards and from the lateral face towards the longitudinal axis of the ingot 2. The shaping of ingot 2 is accompanied by the lowering of said ingot together with the bottom plate 5. At the beginning of casting, the cooling medium is supplied from all of the cooling tiers 3, 6, 7 and 8.

In the given example, the topmost cooling tier 3 is arranged at a distance of 5 to 15 mm from the bottom edge of the inductor 4. Investigations and experiments have indicated that the topmost cooling tier substantially affects the velocity of motion of the liquid-solid interface on the lateral face of the ingot 2. The ratio of the velocity at which the ingot 2 is pulled out of the zone of action of the inductor 4 to the velocity of motion of the liquid-solid interface in the ingot 2 should be so adjusted as to give molten metal at the top face of the ingot 2 enough time to solidify before it leaves the inductor 4 and thus to prevent it from flowing all over the ingot 2. In accordance with the invention, the procedure is adhered to in a sequential cut out or cut off of the coolant of said cooling tiers. As the bottom of the ingot 2 becomes level with the next cooling tier 6, along the motion of the ingot 2, located at a distance $h_1$ from the mid-height of the inductor 4, the topmost cooling tier 3 is cut out or its coolant flow cut off. The remaining cooling tiers supply, cooling medium until casting ends, upon the lateral face of the ingot 2 as long as they maintain the liquid-solid interface on the lateral face of the ingot 2 substantially at the mid-height of the inductor 4.

As the bottom of the ingot 2 becomes level with the next cooling tier 7 arranged at a distance $h_2$ from the mid-height of the inductor 4, the cooling tier 6 is likewise cut out or its coolant flow cut off, and the liquid-solid interface thereby continuously fails to flow over onto the outside solidified lateral face of the solidifying ingot 2.

For the smaller ingot pulling velocities, casting may be stabilized by the third cooling tier 7 located at a distance $h_2$ from the mid-height of the inductor 4 or by the fourth cooling tier 8 arranged at a distance $h_3$ from the mid-height of the inductor 4, all of the overlying cooling tiers being cut out or cut off after the initial stage of casting.

To put the method into effect, according to the invention, it is sufficient to provide 4 to 6 cooling tiers which are capable of covering all the required range of ingot pulling velocities.

The proposed method was used to cast a 485-mm dia. ingot of high-alloy aluminium at pulling velocities from 23 to 28 mm/min. The distance between the topmost cooling tier 3 and the second cooling tier 6 was 50 mm, and the value $h_1$, was approximately 70 to 85 mm.

What is claimed is:

1. A method of continuous or semi-continuous casting of metal comprising: feeding liquid metal upon a bottom plate located inside an orifice of an annular inductor; shaping said liquid metal into an ingot by the electromagnetic field of said annular inductor; lowering said bottom plate as the ingot is solidified from said liquid metal simultaneously with the supply of a cooling medium upon the lateral face of the ingot with the aid of a plurality of cooling tiers arranged at different levels along the ingot; cutting off said cooling medium sequentially in said cooling tiers, beginning from the topmost tier, as the bottom of the ingot becomes level with a next cooling tier along the motion of the ingot, and supplying cooling medium until the casting is completed by the cooling tier that maintains the liquid-solid interface on the lateral face of the ingot substantially at the mid-height of the inductor.

2. The method of claim 1, wherein 4 to 6 cooling tiers are employed so as to cover a predetermined range of ingot pulling velocities.

3. The method of claim 1, wherein the ratio of the velocity at which the ingot is pulled out of the zone of action of said inductor to the velocity of motion of the liquid-solid interface in said ingot is adjusted so as to provide enough time for the molten metal at the top face of said ingot to solidify before it leaves said inductor.

* * * * *